US009198555B2

(12) United States Patent
Tannijärvi et al.

(10) Patent No.: US 9,198,555 B2
(45) Date of Patent: Dec. 1, 2015

(54) MOP COVER

(75) Inventors: Ulla Tannijärvi, Salo (FI); Keijo Lindholm, Salo (FI)

(73) Assignee: Carl Freudenberg KG, Weinheim (DE)

( * ) Notice: Subject to any disclaimer, the term of this patent is extended or adjusted under 35 U.S.C. 154(b) by 676 days.

(21) Appl. No.: 11/908,366

(22) PCT Filed: Jan. 20, 2006

(86) PCT No.: PCT/EP2006/000484

§ 371 (c)(1), (2), (4) Date: Sep. 11, 2007

(87) PCT Pub. No.: WO2006/097154

PCT Pub. Date: Sep. 21, 2006

(65) Prior Publication Data

US 2008/0169052 A1 Jul. 17, 2008

(30) Foreign Application Priority Data

Mar. 16, 2005 (EP) ..... 05005712

(51) Int. Cl.

| | |
|---|---|
| ***A47L 13/20*** | (2006.01) |
| ***A47L 13/255*** | (2006.01) |
| ***A47L 13/24*** | (2006.01) |
| ***A47L 13/258*** | (2006.01) |
| ***A47L 13/256*** | (2006.01) |
| ***A47L 13/254*** | (2006.01) |

(52) U.S. Cl.

CPC ..... *A47L 13/20* (2013.01); *A47L 13/24* (2013.01); *A47L 13/254* (2013.01); *A47L 13/255* (2013.01); *A47L 13/256* (2013.01); *A47L 13/258* (2013.01)

(58) Field of Classification Search

USPC ..... 15/228, 247

IPC ..... A47L 13/20; B65D 65/02

See application file for complete search history.

(56) References Cited

U.S. PATENT DOCUMENTS

| | | | | | |
|---|---|---|---|---|---|
| 2,269,424 | A | * | 1/1942 | Bernstein | 15/228 |
| 4,114,223 | A | * | 9/1978 | Buchanan | 15/228 |
| 4,564,969 | A | * | 1/1986 | Heinonen | 15/147.2 |
| D310,589 | S | * | 9/1990 | Paciullo et al. | D32/40 |
| 5,177,831 | A | * | 1/1993 | Wirth | 15/244.3 |
| 5,292,582 | A | * | 3/1994 | Gibbs et al. | 442/329 |
| 5,455,980 | A | * | 10/1995 | Buchanan | 15/228 |
| 5,864,914 | A | * | 2/1999 | Salmon | 15/147.2 |
| 6,389,637 | B1 | * | 5/2002 | Hurell | 15/247 |
| 7,237,295 | B2 | * | 7/2007 | Lindholm | 15/147.2 |
| 2002/0189040 | A1 | * | 12/2002 | Svendsen | 15/104.93 |

FOREIGN PATENT DOCUMENTS

| | | | |
|---|---|---|---|
| DE | 44 27 672 | A1 | 5/1996 |
| EP | 0 938 863 | A2 | 9/1999 |
| GB | 360301 | A | 11/1931 |
| JP | 11089776 | A | 4/1999 |

OTHER PUBLICATIONS

Patent Abstracts of Japan, vol. 1999, No. 9 (Jul. 30, 1999).

* cited by examiner

*Primary Examiner* — Monica Carter
*Assistant Examiner* — Stephanie Berry
(74) *Attorney, Agent, or Firm* — Leydig, Voit & Mayer, Ltd.

(57) ABSTRACT

The invention relates to a mop cover (1) for a cleaning device. Said mop cover comprises at least two layers (2, 3) that are interlinked in a manner so as to configure a pouch-type mop cover (1) having an insertion end (4). The layers (2, 3), on their faces (5, 6) facing away from each other, configure a wiping surface and the insertion end (4) can be permanently closed in some sections.

8 Claims, 3 Drawing Sheets

MOP COVER

TECHNICAL FIELD

The present invention relates to a mop cover for a cleaning device, comprising two layers, which are connected to each other in a way so as to configure a pouch-type mop cover that has an insertion end, where the layers are configured on their faces facing away from each other as a wiping surface.

STATE OF THE ART

Such mop covers are known from DE 44 27 672 A1. The previously known mop cover presents two layers that are connected to each other, where the mop cover presents an insertion end through which the mop cover can be clamped onto a cleaning device. For fixation of the mop cover to the cleaning device, the previously known mop cover presents on the insertion end, strips with a Velcro closure. By means of the strips, after the mop cover has been clamped in, the two layers are connected to each other on the insertion end. The disadvantage of a Velcro closure or another detachable closure is that the mop cover can become detached on its own when it is used intensively.

PRESENTATION OF THE INVENTION

The invention is based on the problem of providing a mop cover that can be clamped to a cleaning device in such a way that it cannot become separated.

To solve the problem, the insertion end is closed in sections. As a result of the undetachable closure, there is an undercut into which the mop plate of the cleaning device engages during the clamping, resulting in the mop cover being held on the mop plate in such a way that it cannot become detached. The mop plate here is advantageously designed so that it presents an elongated shape, where a small side is configured so it is flexible to be able to shorten the long side for clamping the mop cover. As a result of this undercut, the accidental detachment of the mop cover is prevented. This is particularly advantageous with mop covers where both layers each present a wiping surface, which can be brought alternatively in contact with the surface to be cleaned.

In the case of a mop cover that is configured on both sides as a wiping surface, it is particularly advantageous that, with the same quantity of threads in the wiping surface, the achievable performance in terms of surface area covered is greater.

The layers can be configured to be rectangular, and they can be connected to each other on three sides, where one side forms the insertion end. As a result of the rectangular arrangement, the cleaning result is good in the edge areas of the surface to be cleaned. In the process, two sides can be designed as transverse sides, and two sides as long sides. The elongated configuration of the mop cover, because of the larger working width, allows a more rapid wiping of unobstructed surfaces, or it allows reaching of small passages with the small side.

The insertion end can, starting at its respective corners, be closed in a partial section. As a result, on both corners of the insertion end, an undercut is produced, which prevents any undesired detachment of the mop cover from the mop plate.

One partial section can be configured to be longer than the other partial section. Here, one partial section can present a length that is twice that of the other partial section. This simplifies the clamping of the mop cover to the cleaning device, because the mop cover is held firmly on the side with the shorter partial section, and the mop plate is introduced into the undercut of the longer partial section, and, finally, the mop plate is introduced into the undercut of the shorter partial section, where a lower force needs to be exerted.

A loop can be arranged on one corner of the mop cover. Through the loop, the mop cover can be taken out of a container, without having to come in contact with the wiping surfaces. This is advantageous particularly if the mop covers are preimpregnated before cleaning with disinfecting solution. The loop is ergonomic, and it improves the force transmission during the clamping and the removal of the mop cover. The loop can be designed as a finger hold or hand hold.

The loop can be arranged on the corner that is associated with the shorter partial section. This improves the force transmission to the mop cover during the clamping on the mop plate. In the process, the loop can also extend along the transverse side of the mop cover.

The mop cover can present a color coding. The color coding can be assigned to individual elements of the mop cover. By means of the color coding, certain properties of the mop cover, such as, for example, abrasiveness, absorption or effectiveness against certain types of dirt, can be assigned to certain colors. The colors improve the ability to distinguish the different mop covers. Using the color coding, it is also possible to assign certain colors to certain cleaning tasks. The color coding here can be arranged on the loop, where the loop can be dyed, or detachable clip-on elements or rivets can be attached to the loop. In other embodiments, the color coding can be arranged on the edge of the band that encloses the edge of the layers. In yet other embodiments, the cleaning fringes or the carrier material of the mop cover can be dyed at least partially.

The layers can be configured to be trapezoid. The trapezoid configuration simplifies the cleaning of corners.

At least one of the layers can present a cutout that is open towards the insertion end. Because of the cutout, the mop cover is always applied against the mop plate, even when the joint with the handle of the cleaning apparatus is arranged in the area of the center of gravity and thus in the middle of the mop plate. This prevents penetration of dirt between the mop plate and the mop cover. The cutout can also be configured in the shape of a V. A V-shaped cutout allows the lateral tilting of the handle in the direction of the short sides of the mop plate, without the mop cover being lifted. The cutouts of the layers here can be arranged so they overlap if the cutout is provided in both layers.

The layers may be different from each other. Here, each of the layers can be provided with different wiping surfaces. One wiping surface can then be provided as a result of the configurations of the cleaning fibers for preliminary cleaning, and one wiping surface can be provided for a secondary cleaning. The layers can also differ in color.

The layers can be connected to each other by a seam. A seam is a simple and cost effective possibility of an undetachable fastening. Additional fastening types are, for example, gluing or ultrasound welding.

The mop cover can be elastically expandable. For this purpose, each of the layers of the mop cover can present, for example, in the area of the cutouts, a strip made of an elastomer material, which runs from one side to the opposite side. As a result, the mop cover becomes expandable, for example, in the lengthwise direction, and the mop cover can be clamped onto mop plates configured to be rigid. In the case of mop plates that are configured to be movable, there is also a reduction in the force exerted.

The problem is solved furthermore by a mop system comprising a mop cover according to the invention and a cleaning device comprising a mop plate, which is connected by a joint to a handle, where the mop plate presents two main sides that are attached in such a way that each main side can be pivoted as desired in the direction towards the floor to be cleaned.

Here, appropriate cleaning devices are particularly those that present a flat mop plate, and a handle that is connected by a joint to the mop plate, where the joint presents a pivoting axis, which extends parallel to the lengthwise direction of the mop cover carrier, in order to be able to pivot, as desired, one or the other main sides of the mop plate in a position that extends parallel to a surface to be cleaned, characterized in that the mop plate, at least at one end, is provided with an extension that can be shifted along its lengthwise extent in the direction towards the joint.

In such cleaning devices, the mop covers according to the invention can be clamped particularly advantageously. As a result of the extension, which can be shifted in the lengthwise direction, the mop plate can be moved without force exertion behind the undercuts. An accidental detachment is not possible because the extension cannot be shifted during the cleaning since the wiping direction does not correspond to the direction in which the extension can be shifted.

BRIEF DESCRIPTION OF THE DRAWINGS

Several embodiment examples of the mop cover according to the invention and of the mop system according to the invention are explained below with reference to the figures. Shown schematically are.

EMBODIMENT OF THE INVENTION

Figure 1:
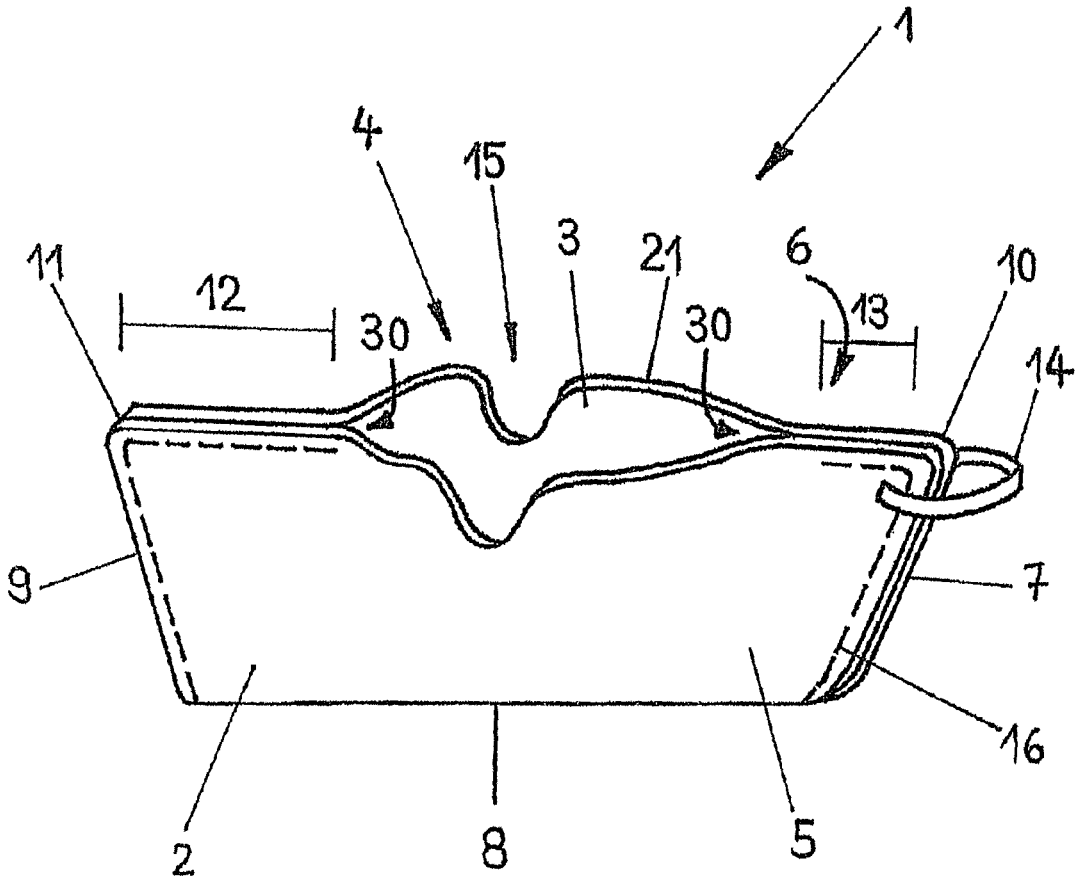
FIG. 1 the mop cover according to the invention.

FIG. 1 shows a mop cover 1 for a cleaning device formed from two layers 2, 3. The two layers 2, 3 are trapezoid and thus configured to be quadrilateral. The layers 2, 3 are configured on their surfaces 5, 6 that face away from each other as wiping surfaces. In this embodiment, there are two transverse sides 7, 9 and two long sides 21, 8. The layers 2, 3 at the transverse sides 7, 9 and at a long side 8 are connected to each other continuously by a seam 16. In other embodiments, the layers 2, 3 can also be connected to each other by gluing or ultrasound welding. The long side 21, at which the layers 2, 3 are not completely connected to each other, forms the insertion end 4. As a result, the mop cover 1 is configured to form a pouch. The insertion end 4 is partially undetachable, and in this embodiment it is closed by the seam 16. As a result, an undercut 30 is formed in which the mop plate is engaged, and thus held by a position connection. Each insertion end 4, starting at its corners 10, 11, is closed here along a partial section 12, 13, where the partial section 12 is longer, in comparison to the other partial section 13. In this embodiment, the partial section 12 presents a length that is twice as long. In the corner 10, which is assigned to the shorter partial section 13, a finger or hand hold forming loop 14 is attached. The loop 14 is provided with a color coding, which allows a simple assignment of the mop cover 1 to predetermined cleaning tasks. Both layers 2, 3 present a cutout 15 in the shape of a V that opens towards the insertion end 4. The two cutouts 15 are arranged so they overlap, and they prevent lifting of the mop cover 1 from the mop plate 17 (shown in FIG. 3) of the cleaning device 16, and thus penetration of dirt. The layers 2, 3 present identically configured wiping surfaces 5, 6. In other embodiments, the wiping surfaces 5, 6 can also be configured differently.

Figure 2:
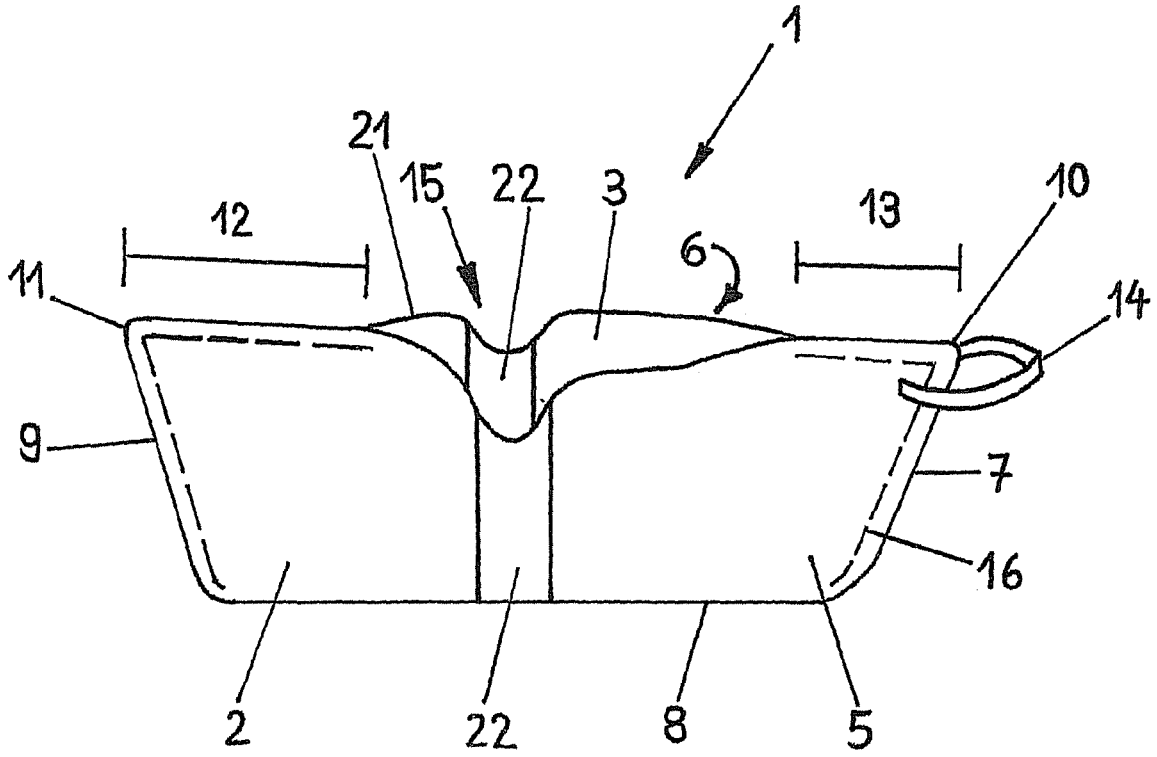
FIG. 2 a mop cover in an expandable form.

FIG. 2 shows a mop cover according to FIG. 1, where the layers 2, 3 of the mop cover 1, in the area of the cutout 15, each present a small strip 22 made of a textile elastomer material, which runs from one long side 21 to the opposite long side 8. The result is a mop cover 1 that is expandable in the lengthwise direction.

Figure 3:
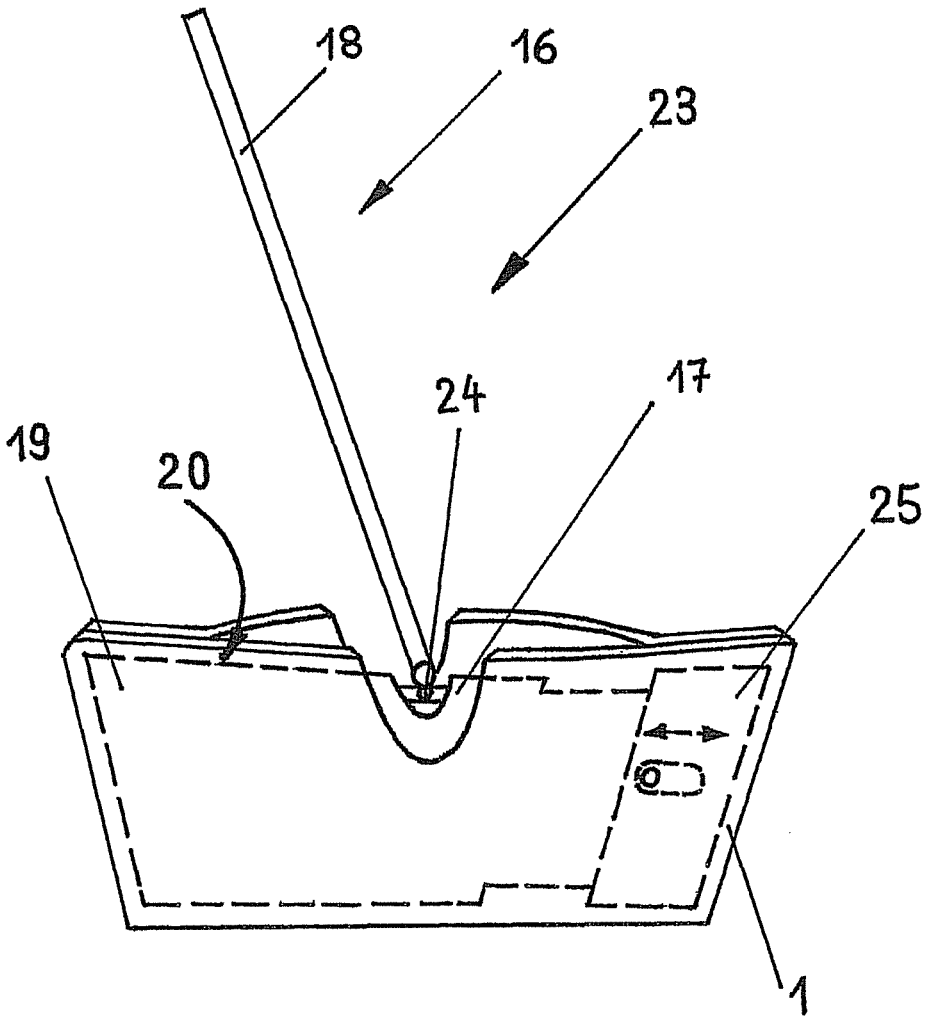
FIG. 3 the mop system according to the invention.

FIG. 3 shows a mop system consisting of a mop cover 1, according to FIG. 1 or FIG. 2, and a cleaning device 16. The cleaning device 16 consists of a mop plate 17, which is connected by joint 28 to a handle 18. The mop plate 17 presents two main sides 19, 20, which are attached in such a way that each main side 19, 20 can be pivoted as desired in the direction of the floor to be cleaned. The mop plate 17 presents an extension 25 that can be shifted in the lengthwise direction.

The invention claimed is:

1. A mop system comprising:

a cleaning device including a mop plate having an elongated shape and opposing first and second surfaces and being constructed such that at least a portion thereof is flexibly movable in a longitudinal direction, a handle connected to the mop plate by a joint, the joint disposed closer to an edge of the mop plate than to a center of the mop plate such that the mop plate is pivotable about the handle to present the first or second opposing surfaces in a direction towards a floor to be cleaned; and a mop cover comprising two layers having a trapezoidal shape, the two layers being connected to each other in such a way that they configure a pouch-type mop cover, the layers each having a multilateral configuration with the layers connected to each other at a plurality of side edges via side seams so as to define an interior space for receiving the mop plate and one longitudinal side edge forming an insertion end through which the mop plate of the cleaning device is insertable into the interior space, wherein each layer has an outward facing surface that is configured as a wiping surface and is arrangeable over a respective one of the opposing first and second surfaces of the mop plate, wherein the layers are connected to each other in such a way that partial sections of the insertion end starting at each respective corner of the insertion end is closed via partial section seams with the interior space extending along an inner side of each of the partial section seams along the length of the insertion end such that the partial section seams define undercut portions into which the mop plate is insertable and engageable when the mop cover is arranged thereon with the partial section starting at one of the respective corners of the insertion end being longer than the other partial section, wherein the partial sections are present in the connected layers prior to arrangement of the mop cover on a cleaning device and with the two layers in a non-expanded condition.

2. Mop system according to claim 1, wherein the layers are configured to be quadrilateral, and in that the layers are connected to each other at three side edges, and one side edge forms the insertion end.

3. Mop system according to claim 1, wherein a loop is arranged at one corner.

4. Mop system according to claim 1, wherein a loop is arranged at the corner that is associated with the shorter partial section.

5. Mop system according to claim 3, wherein the mop cover presents a color coding.

6. Mop system according to claim 1, wherein at least one of the layers presents a cutout that is open towards the insertion end, said cutout accommodating a clearance to the joint such that the handle can pivot freely with respect to the mop plate.

7. Mop system according to claim 1, wherein the layers are different from each other.

8. Mop system according to claim 1, wherein the mop cover is elastically expandable along an elastomer material strip portion thereof.

* * * * *